US008888566B2

(12) United States Patent
Sunazuka et al.

(10) Patent No.: US 8,888,566 B2
(45) Date of Patent: Nov. 18, 2014

(54) POWER TOOL

(75) Inventors: Ryo Sunazuka, Anjo (JP); Hirokatsu Yamamoto, Anjo (JP); Takaaki Osada, Anjo (JP)

(73) Assignee: Makita Corporation, Anjo-shi (JP)

( * ) Notice: Subject to any disclaimer, the term of this patent is extended or adjusted under 35 U.S.C. 154(b) by 408 days.

(21) Appl. No.: 13/297,803

(22) Filed: Nov. 16, 2011

(65) Prior Publication Data

US 2012/0129436 A1 May 24, 2012

(30) Foreign Application Priority Data

Nov. 22, 2010 (JP) ..... 2010-260220

(51) Int. Cl.
*B24B 23/00* (2006.01)
*B25F 5/00* (2006.01)
*B24B 41/00* (2006.01)

(52) U.S. Cl.
CPC ..... *B25F 5/006* (2013.01); *B24B 41/007* (2013.01)
USPC ..... 451/359; 451/344; 173/162.2

(58) Field of Classification Search
CPC ..... B25F 5/006
USPC ..... 451/344, 359, 451; 173/162.1, 162.2
See application file for complete search history.

(56) References Cited

U.S. PATENT DOCUMENTS 3,692,370 A * 9/1972 Hasz ..... 384/280
4,371,043 A * 2/1983 Kubokawa ..... 173/162.2
4,388,972 A * 6/1983 Gidlund ..... 173/162.1
5,077,942 A * 1/1992 Jacobsson ..... 451/344
5,692,574 A * 12/1997 Terada ..... 173/162.2
5,697,456 A * 12/1997 Radle et al. ..... 173/162.2
7,331,407 B2 * 2/2008 Stirm et al. ..... 173/201
2006/0076154 A1 * 4/2006 Aoki ..... 173/212
2006/0272836 A1 * 12/2006 Hirayama et al. ..... 173/109
2006/0289183 A1 * 12/2006 Schreiber ..... 173/162.2
2007/0212990 A1 * 9/2007 Kuragano et al. ..... 451/359
2010/0314147 A1 * 12/2010 Muller et al. ..... 173/171

FOREIGN PATENT DOCUMENTS

JP 01274973 A * 11/1989
JP A-2007-237357 9/2007

* cited by examiner

*Primary Examiner* — Lee D Wilson
*Assistant Examiner* — Tyrone V Hall, Jr.
(74) *Attorney, Agent, or Firm* — Oliff PLC

(57) ABSTRACT

An improved hand-held power tool is provided which can effectively reduce whirling vibration caused by imbalance of a rotating element. The power tool has a grip that is connected to a tool body and designed to be held by a user and a self-synchronous mechanism that reduces whirling vibration caused in the tool body or the grip when the tool bit is driven. The self-synchronous mechanism is of a phase variable type, having a rotating body which serves as a vibrator and is rotationally driven by a driving source different from a driving source for the tool bit. The self-synchronous mechanism is disposed in the tool body or the grip in which whirling vibration is caused, and arranged such that a phase of vibration of the rotating body is automatically tuned to a phase of the whirling vibration, thereby reducing the whirling vibration.

8 Claims, 4 Drawing Sheets

POWER TOOL

BACKGROUND OF THE INVENTION

1. Field of the Invention

The invention relates to a hand-held power tool which can reduce whirling vibration caused in a tool body or a grip when a tool bit is driven.

2. Description of the Related Art

Japanese non-examined laid-open Patent Publication No. 2007-237357 discloses a hand-held power tool such as an electric disc grinder having a vibration-proofing structure for reducing transmission of vibration from a tool body in the form of a housing to a grip. In the above-mentioned known vibration-proofing structure, the grip is connected to an axial end of the housing via a spherical structure and an elastic member is disposed between the housing and the grip so that transmission of vibration from the housing to the grip is reduced.

In the electric disc grinder which performs a grinding/polishing operation by rotation of a tool bit in the form of a grinding wheel, when rotating elements (a grinding wheel, a motor, etc.) provided in the electric disc grinder are rotationally driven, if the rotating elements are out of balance with respect to the rotation axis (the center of mass and the center of rotation are misaligned), the rotating elements whirl or rotate on its rotation axis displaced in a direction (radial direction) perpendicular to the rotation axis. Then, the tool body or the grip is caused to perform a swinging movement (circular or elliptic movement) around the center of gravity of the electric disc grinder.

Specifically, the tool body or the grip is caused to swing on the center of gravity of the electric disc grinder, with runout of its long axis in a direction perpendicular to the long axis, so that whirling vibration is caused. Such whirling vibration is constantly caused regardless of the presence or absence of load on the grinding wheel. In the known vibration-proofing structure in which transmission of vibration to the grip is reduced by using the elastic member, however, the above-described whirling vibration cannot be adequately reduced. In this point, further improvement is desired.

SUMMARY OF THE INVENTION

Accordingly, it is an object of the invention to provide an improved hand-held power tool which can effectively reduce whirling vibration caused by imbalance of a rotating element.

Above-described object is achieved by a claimed invention. The representative power tool is provided which has a tool body and performs a predetermined operation by driving a tool bit attached to the tool body via a predetermined driving source.

The power tool has a grip that is connected to the tool body and designed to be held by a user, and a self-synchronous mechanism that reduces whirling vibration caused in the tool body or the grip when the tool bit is driven. The self-synchronous mechanism is of a phase variable type and has a rotating body which serves as a vibrator and is rotationally driven by a driving source different from the driving source for the tool bit. Further, the self-synchronous mechanism is disposed in the tool body or the grip in which whirling vibration is caused, and arranged such that a phase of vibration of the rotating body is automatically tuned to a phase of the whirling vibration of the tool body or the grip, thereby reducing the whirling vibration.

The "power tool" according to the invention is typically represented by a hand-held rotary tool such as an electric disc grinder and a brush cutter which performs an operation on a workpiece by rotationally driving a tool bit. The "whirling vibration caused in the tool body or the grip" here refers to a vibration caused by swinging movement (circular or elliptical movement) of the tool body or the grip around the center of gravity of the power tool, and this swinging movement is caused by rotation of a rotating element of the power tool with the center of mass (center of gravity) of the rotating element misaligned from the rotation axis of the rotating element, or by runout (wobble) of the rotating element in a direction (radial direction) perpendicular to the rotation axis of the rotating element. In other words, it is a vibration caused when the tool body or the grip rotates with runout of its long axis in a direction perpendicular to the long axis. Generally, such a power tool has a plurality of rotating elements. Therefore, the rotational speed of the rotating body of the self-synchronous mechanism is preferably set to coincide with the rotational speed of one or more of the rotating elements which cause whirling vibration in the power tool.

According to the invention, when the tool bit of the power tool is driven and the whirling vibration is caused in the tool body or the grip, the phase of vibration of the rotating body of the self-synchronous mechanism which is rotationally driven separately from the tool bit is automatically tuned to the phase of the whirling vibration of the tool body or the grip. Thus, whirling vibration caused in the tool body or the grip can be reduced.

The manner in which "the phase of vibration of the rotating body is automatically tuned to the phase of the whirling vibration of the tool body or the grip" here is referred to as the manner (phenomenon) in which, in order to reduce vibration of a vibrating element (the tool body or the grip), a different vibrating element (the rotating body) of a phase variable type is provided, and the amplitude and frequency of vibration of the phase variable vibrating element is tuned to those of vibration of the vibrating element to be reduced, and at this time, the phase of vibration of the phase variable vibrating element is automatically adjusted, over time after driving of the motor, to be opposite to the phase of vibration of the vibrating element to be reduced. In this case, complete agreement between the amplitudes is not an essential requirement, but it is only necessary that at least part of the amplitude can be canceled out.

According to a further embodiment of the invention, the rotating body is arranged such that its rotation axis extends perpendicularly or transversely to a plane of the whirling vibration caused in the tool body or the grip. With such arrangement, the phase of the rotating body can be efficiently tuned to the phase of the whirling vibration.

According to a further embodiment of the invention, the tool bit is rotationally driven and rotation axes of the tool bit and the rotating body intersect each other. Therefore, in the case of an electric disc grinder in which the tool bit in the form of a grinding wheel is mounted to a front end region of the elongate tool body in its longitudinal direction and can rotate around the rotation axis extending in a direction transverse to the longitudinal direction of the tool body, the rotating body can be disposed on the tool body side along the longitudinal direction, so that an installation space for the rotating body can be easily ensured.

According to a further embodiment of the invention, the rotating body is disposed on an opposite side of a center of gravity of the power tool from the tool bit. The whirling vibration caused in the tool body or the grip is a rotational movement around the center of gravity of the power tool. Therefore, with this construction, the whirling vibration caused in the tool body or the grip can be efficiently reduced.

According to a further embodiment of the invention, the rotating body comprises a weight placed in a position displaced from its rotation axis. According to the invention, by adjusting the mass of the weight or the distance of displacement of the weight from its rotation axis, the amplitude of vibration of the phase variable vibrating element can be easily adjusted to the amplitude of vibration of the vibrating element to be reduced.

According to a further embodiment of the invention, the power tool has a main motor that serves as the driving source for driving the tool bit and an auxiliary motor that serves as the driving source for rotationally driving the rotating body. Further, the driving source of the main motor also serves as the driving source of the auxiliary motor. Both an AC source and a DC source can be used as the "driving source" here.

According to the invention, an improved hand-held power tool is provided which can effectively reduce whirling vibration of a grip.

Other objects, features and advantages of the present invention will be readily understood after reading the following detailed description together with the accompanying drawings and the claims.

DETAILED DESCRIPTION OF THE INVENTION

Figure 1:
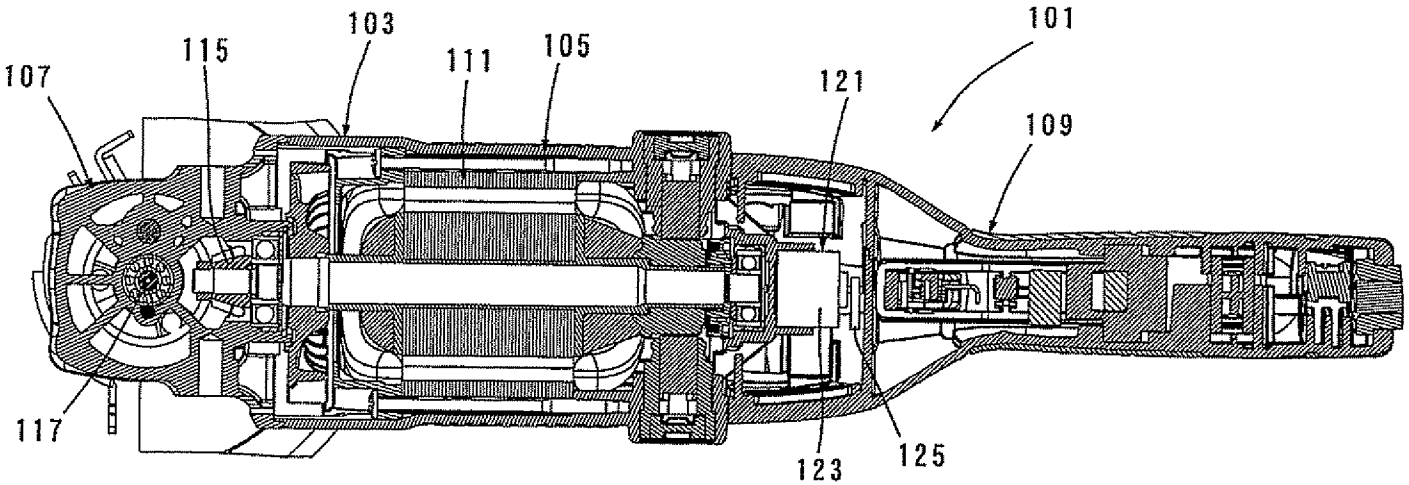
FIG. 1 is a sectional view showing the entire structure of an electric disc grinder according to this embodiment.

Each of the additional features and method steps disclosed above and below may be utilized separately or in conjunction with other features and method steps to provide and manufacture improved power tools and method for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

An embodiment of the invention is now described with reference to FIGS. 1 to 4. In this embodiment, an electric disc grinder is explained as a representative example of a hand-held power tool according to the invention. The electric disc grinder 101 (herein after referred to as the disc grinder) mainly includes a body 103 that forms an outer shell of the disc grinder 101, and a grinding wheel 113 (see FIG. 3) that is disposed in a front end region of the body 103. The body 103 mainly includes a motor housing 105 and a gear housing 107. The body 103 and the grinding wheel 113 are features that correspond to the "tool body" and the "tool bit", respectively, according to the invention. For the sake of convenience of explanation, the grinding wheel 113 side in a longitudinal direction of the body 103 is taken as the front and its opposite side as the rear.

FIG. 1 shows the internal structure of the disc grinder 101. As shown in FIG. 1, the motor housing 105 has a generally cylindrical shape and houses a driving motor 111 in its internal space. The driving motor 111 is a feature that corresponds to the "driving source for driving the tool bit" and the "main motor" according to the invention. The driving motor 111 is disposed such that its rotation axis extends parallel to the longitudinal direction of the disc grinder 101 or the longitudinal direction of the body 103.

Figure 3:
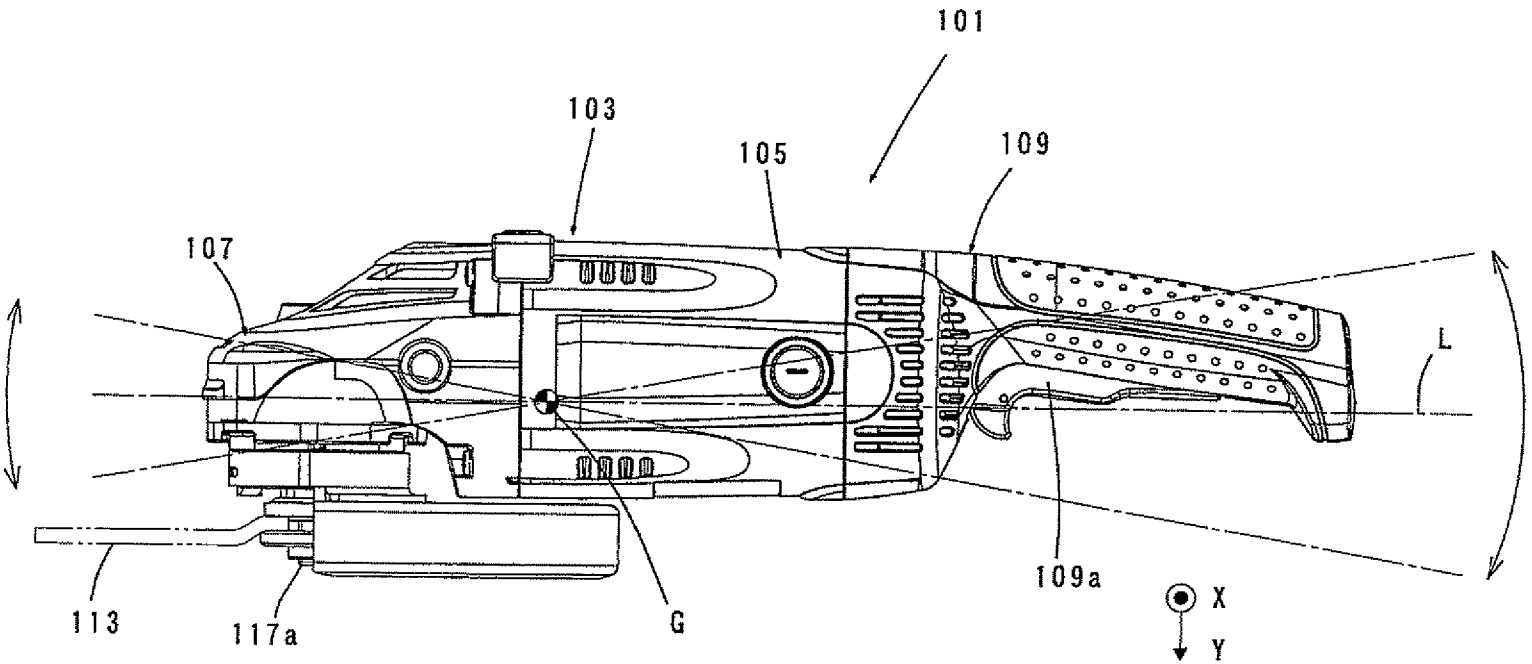
FIG. 3 is a side view also showing an external appearance of the electric disc grinder.

The gear housing 107 is connected to a front end (left end as viewed in FIG. 1) of the motor housing 105 and houses a power transmitting mechanism (including a driving gear 115 and a final output shaft in the form of a spindle 117 shown in FIG. 1 as its components) for transmitting rotating output of the driving motor 111 to the grinding wheel 113. The grinding wheel 113 is a feature that corresponds to the "tool bit" according to this invention. The rotating output of the driving motor 111 is transmitted as rotation in a circumferential direction to the grinding wheel 113 via the power transmitting mechanism 115, 117. The spindle 117 is disposed on one end (front end) of the body 103 in the longitudinal direction and extends in a vertical direction such that its rotation axis extends perpendicularly to the longitudinal direction of the body 103 (to the rotation axis of the driving motor 111). Further, as shown in FIG. 3, one end of the spindle 117 in the extending direction (axial direction) protrudes a predetermined length from the gear housing 107 to the outside, and this protruding end is designed as a grinding wheel mounting part 117*a* for mounting the grinding wheel 113. The grinding wheel 113 is removably attached to the grinding wheel mounting part 117*a* of the spindle 117 and rotates together with the spindle 117.

Figure 2:
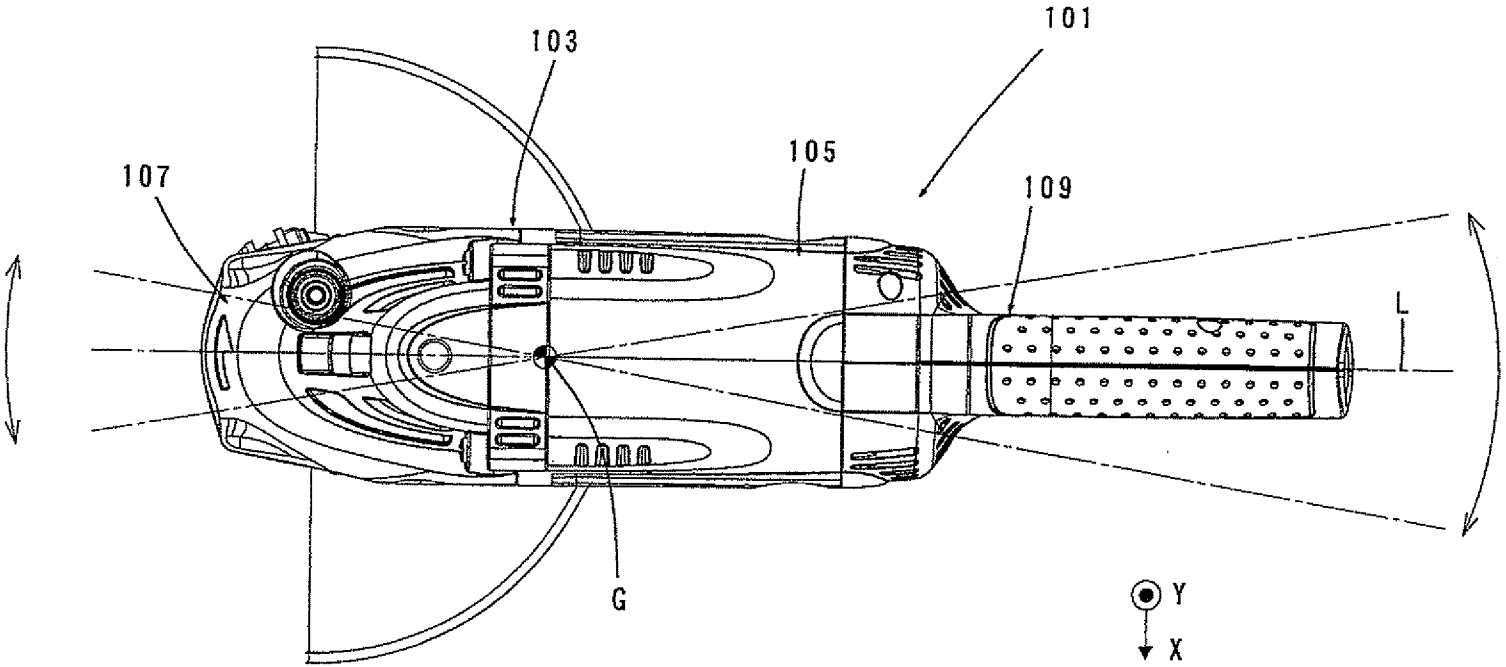
FIG. 2 is a plan view showing an external appearance of the electric disc grinder.

A grip 109 is integrally connected to a rear end (right end as viewed in the drawings) of the motor housing 105 and designed to be held by a user when operating the disc grinder 101 to perform an operation. As shown in FIG. 2, the grip 109 consists of two halves by dividing along the axial direction. Front end portions of the right and left grip halves are fitted over a rear end portion of the motor housing 105, and in this state, the right and left grip halves are fastened to each other by screws (not shown). Thus, the grip 109 is integrated with the motor housing 105. The grip 109 is shaped in a generally cylindrical form having a smaller diameter than the motor housing 105 except in its front end region which is fitted over the rear end portion of the motor housing 105. Further, the grip 109 is designed and provided such that its long axis extends in the longitudinal direction of the body 103. Specifically, the grip 109 substantially linearly extends in the same direction as the longitudinal direction of the body 103. Although not shown, in addition to the grip 109, the disc grinder 101 has an auxiliary grip that can be detachably mounted to a side or top of the gear housing 107. The auxiliary grip is mounted to the gear housing 107 such that its long axis extends substantially perpendicularly to the longitudinal direction of the body 103. The user can hold the grip 109 and the auxiliary grip by the hands and perform grinding, cutting or other similar operation on a workpiece by rotationally driving the grinding wheel 113.

During operation using the disc grinder 101, when the driving motor 111, the grinding wheel 113 and the power transmitting mechanism 115, 117 for transmitting rotating output of the driving motor 111 to the grinding wheel 113 of the disc grinder 101 (hereinafter referred to as rotating elements of the disc grinder 101) are rotationally driven, if the center of mass and the rotation axis of the rotating elements are misaligned (the rotating elements are rotationally asymmetrical), the rotating elements of the disc grinder 101 swing with runout of the rotation axis in a direction perpendicular to the rotation axis, or specifically, the rotating elements cause whirling vibration. This whirling vibration is caused regardless of the presence or absence of load on the grinding wheel 113 when the driving motor 111 is driven and the grinding wheel 113 is rotated. In this embodiment, the whirling vibration is caused mainly due to imbalance of the grinding wheel 113 attached to the output-side spindle 117. As shown in FIGS. 2 and 3, the body 103 or the grip 109 is caused to swing on a center of gravity G of the disc grinder 101 by whirling vibration of the rotating elements. Specifically, the body 103 or the grip 109 is caused to swing with runout in a direction (radial direction) perpendicular to a long axis L of the body 103. More specifically, the body 103 or the grip 109 causes whirling vibration, or swings on the center of gravity G of the disc grinder 101, with runout along a plane (X-Y plane defined by an X-axis perpendicular to a plane of FIG. 3 and a Y-axis extending in the vertical direction in FIG. 3) perpendicular to the long axis L of the body 103 passing through the center of gravity G.

Therefore, in this embodiment, in order to reduce the body-side whirling vibration caused in the body 103 or the grip 109 due to imbalance of the rotating elements of the disc grinder 101, as shown in FIG. 1, a vibration reducing means in the form of a self-synchronous vibration-proofing mechanism 121 is installed in the body 103. The self-synchronous vibration-proofing mechanism 121 is a feature that corresponds to the "self-synchronous mechanism" according to this invention.

Figure 4:
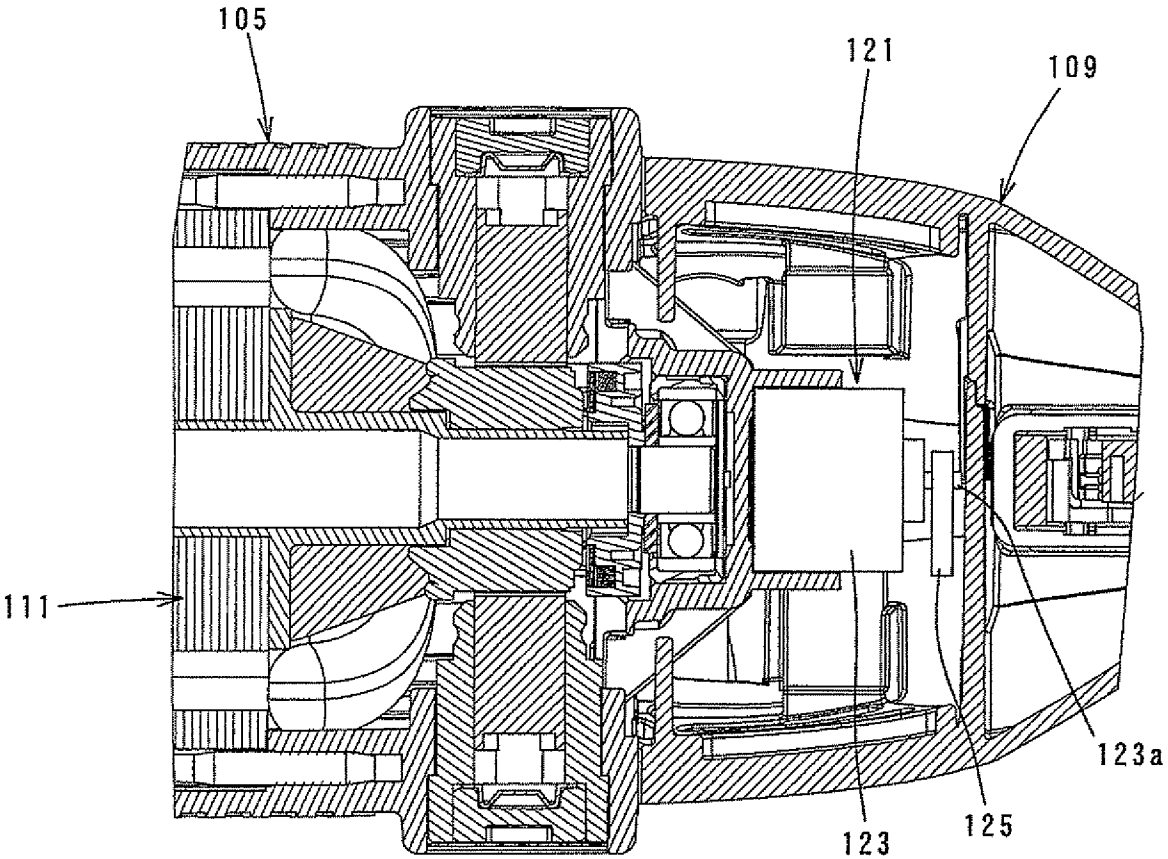
FIG. 4 is an enlarged sectional view showing part of FIG. 1.

As shown in FIG. 4 which is an enlarged view showing part of FIG. 1, the self-synchronous vibration-proofing mechanism 121 mainly includes an auxiliary motor 123 which serves as a driving source of generating vibration, and a vibrator in the form of an eccentric weight 125 which is rotationally driven by the auxiliary motor 123. The eccentric weight 125 is a feature that corresponds to the "rotating body" according to this invention. The eccentric weight 125 is fixedly provided on an output shaft 123*a* of the auxiliary motor 123 and serves as an imbalanced member which is designed such that its center of gravity is placed in a position spaced (displaced) a predetermined distance from a rotation axis of the output shaft 123*a* in a direction transverse to the rotation axis.

The self-synchronous vibration-proofing mechanism 121 is disposed at the rear of the driving motor 111 in the motor housing 105 such that a rotation axis of the auxiliary motor 123 and thus a rotation axis of the eccentric weight 125 extend perpendicularly to a plane (X-Y plane) of whirling vibration caused in the disc grinder 101. Specifically, the rotation axis of the auxiliary motor 123 coincides with the long axis L of the body 103 extending in the longitudinal direction through the center of gravity G of the disc grinder 101. Further, the auxiliary motor 123 and thus the eccentric weight 125 rotate in the same direction as the rotation direction of the whirling vibration caused in the disc grinder 101.

The self-synchronous vibration-proofing mechanism 121 constructed as described above generates whirling vibration along a plane perpendicular to the rotation axis of the eccentric weight 125 when the eccentric weight 125 is rotationally driven by the auxiliary motor 123. In the following description, the whirling vibration generated by the self-synchronous vibration-proofing mechanism 121 is referred to as a weight-side whirling vibration. The self-synchronous vibration-proofing mechanism 121 forms a vibration generator (source of vibration) of a phase variable type which can adjust the phase of the weight-side whirling vibration with respect to the body-side whirling vibration. The self-synchronous vibration-proofing mechanism 121 is adjusted such that the amplitude and frequency of the weight-side whirling vibration conform to those of the body-side whirling vibration. In this embodiment, the rotational speed of the eccentric weight 125 is designed to be equal to the rotational speed of the grinding wheel 113 rotating together with the spindle 117 which causes the body-side whirling vibration. In short, it is set to be equal to the rotational speed of the rotating elements which cause whirling vibration in the body. Further, the amplitude of the weight-side whirling vibration can be adjusted by changing the mass of the eccentric weight 125 and the distance of displacement of the eccentric weight 125 from its rotation axis.

Further, in this embodiment, the driving motor 111 is an AC motor and the auxiliary motor 123 is a DC motor. Therefore, the driving motor 111 is driven by an AC source supplied via a cord from the outside and the auxiliary motor 123 is driven by a DC source supplied via a converter for converting alternate current into direct current. Then the driving motor 111 is driven when a trigger 109*a* on the grip 109 is depressed.

The disc grinder 101 of this embodiment is constructed as described above. When the trigger 109*a* is depressed in order to perform an operation by the disc grinder 101, the driving motor 111 and the auxiliary motor 123 are driven. By driving of the driving motor 111, the grinding wheel 113 is rotationally driven via the power transmitting mechanism 115, 117, which causes the body-side whirling vibration of the body 103 or the grip 109. Further, by driving of the auxiliary motor 123, the eccentric weight 125 is rotationally driven, which causes the self-synchronous vibration-proofing mechanism 121 to generate the weight-side whirling vibration. With the arrangement in which the amplitude and frequency of the weight-side whirling vibration are adjusted to those of the body-side whirling vibration, the phase of the weight-side whirling vibration (the phase of the eccentric weight 125) is automatically adjusted, over time after driving of the motors, to be opposite to the phase of the body-side whirling vibration to be reduced. Specifically, the whirling vibration generated by the self-synchronous vibration-proofing mechanism 121 is tuned in opposite phase to the whirling vibration caused in the disc grinder 101 so as to reduce the whirling vibration without amplifying. As a result, the whirling vibration of the body 103 or the grip 109 can be reduced.

In this manner, according to this embodiment, the imbalanced eccentric weight 125 is provided separately from the rotating elements of the disc grinder 101, and the whirling vibration generated by rotation of the eccentric weight 125 counteracts the whirling vibration caused in the body 103 of the disc grinder 101, so that the whirling vibration of the disc grinder 101 is reduced. Therefore, by adjusting the amplitude and frequency of the whirling vibration of the eccentric weight 125 to those of the body-side whirling vibration to be reduced, vibrations having a wide range of amplitudes and frequencies can be reduced. In this case, complete agreement between the amplitudes is not an essential requirement. For example, even if the amplitude of the whirling vibration of the eccentric weight 125 is smaller than that of the body-side whirling vibration, part of the amplitude of the body-side whirling vibration can be canceled out (reduced).

Further, according to this embodiment, the grip 109 can be integrally formed with or connected to the body 103 by screws or other similar fastening means, so that the mounting rigidity of the grip 109 to the body 103 can be increased. In a vibration-proofing structure using an elastic member as disclosed in the above-described prior art, the grip 109 deforms relative to the body 103 via the elastic member, so that usability (operability) in operation decreases. According to this embodiment, however, as described above, mounting rigidity of the grip 109 can be increased, so that the operability of the grip 109 in operation can be improved.

In this embodiment, the rotation axis of the eccentric weight 125 extends perpendicularly to the plane (X-Y plane) of the body-side whirling vibration. Therefore, the phase of the weight-side whirling vibration is effectively tuned to that of the body-side whirling vibration and the vibration reducing effect can be improved. In order to obtain the vibration reducing effect, however, it is necessary for the rotation axis of the eccentric weight 125 to extend transversely, not only perpendicularly, to the plane of the body-side whirling vibration.

In this embodiment, the self-synchronous vibration-proofing mechanism 121 is installed within the motor housing 105 of the body 103 which is placed on the opposite side of the center of gravity G of the disc grinder 101 from the grinding wheel 113. With this construction, an installation space for the self-synchronous vibration-proofing mechanism 121 can be easily ensured and the body-side whirling vibration can be effectively reduced.

In this embodiment, by adjusting the mass of the eccentric weight 125 or the distance of displacement of the eccentric weight 125 from its rotation axis, the amplitude of the weight-side whirling vibration can be easily adjusted to the amplitude of the body-side whirling vibration to be reduced.

In this embodiment, the driving motor 111 for driving the grinding wheel 113, and the auxiliary motor 123 are driven by a common driving power source, so that a driving circuit can be rationally provided. In this embodiment, an AC source is described as being used as the power source, but a DC source (rechargeable battery) may also be used.

This embodiment is explained as being applied to the disc grinder 101 as a representative example of the power tool, but the invention is not limited to this, and may also be applied to a power tool such as a brush cutter in which whirling vibration is caused in the body or the grip due to imbalance of the rotating elements when the tool bit is rotationally driven.

The driving source of the self-synchronous vibration-proofing mechanism 121 includes not only an electric motor but also an air motor and an engine.

In view of above-described aspects of the invention, the following features are provided.

(1)

"The power tool as defined in any one of claims 1 to 6, wherein the power tool comprises an electric disc grinder in which the tool bit comprises a grinding wheel which is rotationally driven to perform a grinding/polishing operation on a workpiece."

(2)

"The power tool as defined in (1), comprising a main motor that serves as the driving source for driving the tool bit, and an auxiliary motor that serves as the driving source for rotationally driving the rotating body, wherein the main motor and the auxiliary motor are disposed close to each other."

Description of Numerals

101 electric disc grinder (power tool)
103 body (tool body)
103 motor housing
107 gear housing
109 grip
109*a* trigger
111 driving motor (driving source, main motor)
113 grinding wheel (tool bit)
115 driving gear
117 spindle
121 self-synchronous vibration-proofing mechanism (self-synchronous mechanism)
123 auxiliary motor (driving source of the rotating body)
123*a* output shaft
125 eccentric weight (rotating body)

We claim:

1. A power tool comprising:

a tool body wherein the power tool performs a predetermined operation by driving a tool bit attached to the tool body via a first driving source, a grip coupled to the tool body, the grip being configured to be held by a user and a self-synchronous mechanism that reduces whirling vibration caused in at least one of the tool body and the grip when the tool bit is driven, wherein:

the self-synchronous mechanism is defined by a phase variable type, having a rotating body as a vibrator which is rotationally driven by a second driving source that is different from the first driving source, wherein the self-synchronous mechanism is disposed in the at least one of the tool body and the grip where the whirling vibration is caused and is arranged such that a phase of vibration of the rotating body is automatically tuned to a phase of the whirling vibration to reduce the whirling vibration.

2. The power tool as defined in claim 1, wherein the rotating body is arranged such that the rotation axis of the rotating body extends perpendicularly or transversely to a plane of the whirling vibration.

3. The power tool as defined in claim 1, wherein the tool bit is rotationally driven and rotation axes of the tool bit and the rotating body intersect each other.

4. The power tool as defined in claim 1, wherein the rotating body is disposed on an opposite side of a center of gravity of the power tool from the tool bit.

5. The power tool as defined in claim 1, wherein the rotating body comprises a weight placed in a position displaced from its rotation axis.

6. The power tool as defined in claim 1, comprising a main motor that serves as the first driving source for driving the tool bit and an auxiliary motor that serves as the second driving source for rotationally driving the rotating body, wherein:

the first driving source of the main motor also serves as the second driving source of the auxiliary motor.

7. The power tool as defined in claim 1, wherein the power tool comprises an electric disc grinder in which the tool bit comprises a grinding wheel which is rotationally driven to perform a grinding/polishing operation on a workpiece.

8. The power tool as defined in 7 further comprising a main motor as the driving source to drive the tool bit, and an auxiliary motor as the driving source for rotationally driving the rotating body, wherein the main motor and the auxiliary motor are disposed close to each other.

* * * * *